United States Patent [19]

Buttke

[11] 4,042,131

[45] Aug. 16, 1977

[54] SWINGABLE BUCKET FOR EXCAVATORS

[75] Inventor: Frederic P. Buttke, Peoria, Ill.

[73] Assignee: Caterpillar Tractor Co., Peoria, Ill.

[21] Appl. No.: 602,615

[22] Filed: Aug. 7, 1975

[51] Int. Cl.[2] ..... E02F 3/32

[52] U.S. Cl. ..... 214/138 R; 214/768

[58] Field of Search ..... 214/138 R, 768, 77 R

[56] References Cited

U.S. PATENT DOCUMENTS

| | | | |
|---|---|---|---|
| 2,496,696 | 2/1950 | Burner et al. | 214/138 R |
| 3,231,116 | 1/1966 | Powell | 214/138 R |
| 3,289,866 | 12/1966 | Emery | 214/138 R |
| 3,896,950 | 7/1975 | McCain | 214/138 R |

FOREIGN PATENT DOCUMENTS

| | | | |
|---|---|---|---|
| 161,879 | 3/1955 | Australia | 214/138 R |
| 1,142,320 | 1/1963 | Germany | 214/138 R |
| 1,049,307 | 11/1966 | United Kingdom | 214/138 R |

*Primary Examiner*—Robert J. Spar
*Assistant Examiner*—Ross Weaver
*Attorney, Agent, or Firm*—Phillips, Moore, Weissenberger, Lempio & Majestic

[57] ABSTRACT

An excavator comprises a boom having a normally vertically disposed dipper stick pivotally mounted on an end thereof and a support bracket pivotally mounted on a lower end of the dipper stick for to and fro movements in a first plane. The bucket is pivotally mounted on a lower end of the support bracket for sideway movements relative thereto in a second plane perpendicular to the first plane. A first double-acting hydraulic cylinder is pivotally interconnected between an upper end of the dipper stick and an upper side of the bracket to selectively pivot the bracket in the first plane whereas a second double-acting hydraulic cylinder is pivotally mounted on an outer side of the bracket and to the bucket for selectively moving the bucket in the second plane.

4 Claims, 3 Drawing Figures

SWINGABLE BUCKET FOR EXCAVATORS

BACKGROUND OF THE INVENTION

This invention relates to dipper stick and bucket arrangement of the type employed on an excavator for backhoeing and like excavating operations. When such an excavator is digging a vertical trench on a side slope, for example, the relative position of the bucket employed thereon must be adjusted for digging purposes.

Summary of this Invention

An object of this invention is to provide an improved dipper stick and bucket arrangement comprising a work tool universally mounted on the lower end of a dipper stick. The work tool is pivotally mounted on a support bracket which is, in turn, pivotally mounted on the dipper stick. A first actuating means is pivotally interconnected between the dipper stick and support bracket for selectively moving the support bracket in a first plane whereas a second actuating means is disposed alongside the dipper stick and is pivotally interconnected between the support bracket and work tool for pivoting the work tool in a second plane perpendicular to the above-mentioned first plane.

BRIEF DESCRIPTION OF THE DRAWING

Other objects of this invention will become apparent from the following description and accompanying drawing wherein.

DETAILED DESCRIPTION

Figure 1:
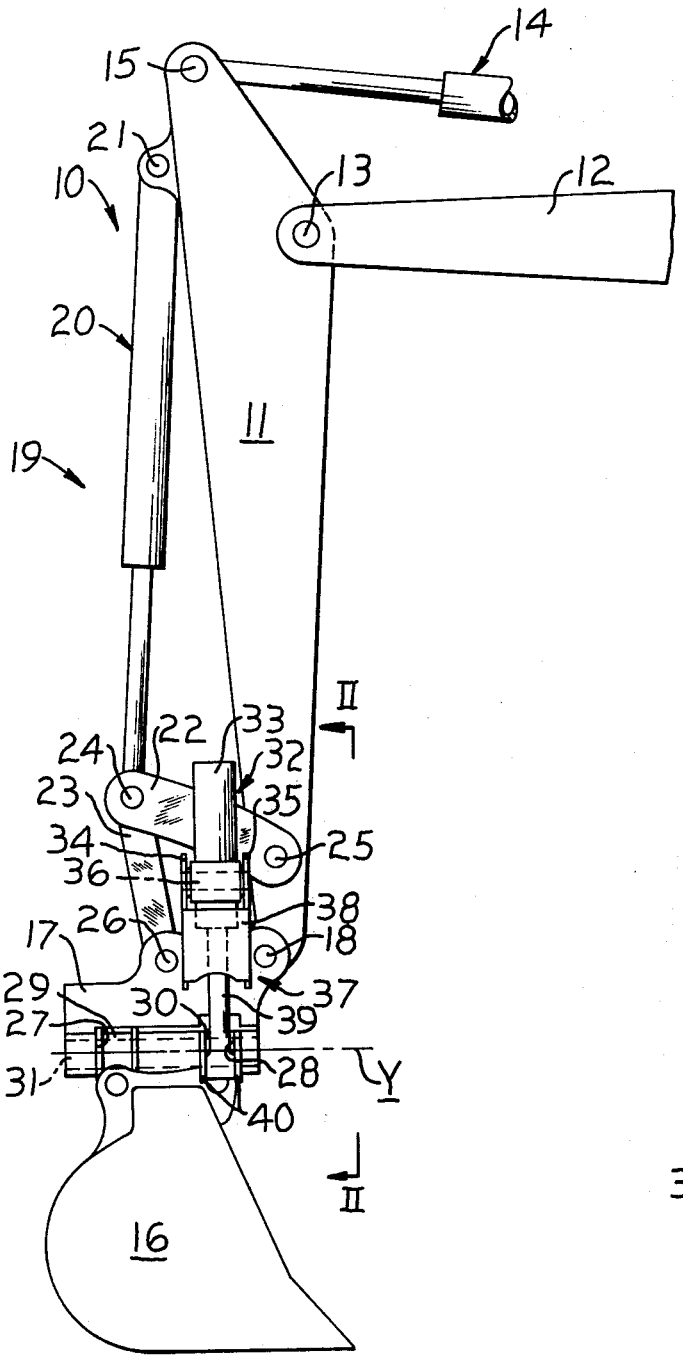
FIG. 1 is a side elevational view of a dipper stick and bucket arrangement of this invention adapted to be mounted on an excavator.

FIG. 1 illustrates a dipper stick and bucket arrangement 10 comprising a normally vertically disposed dipper stick 11 having its upper end pivotally mounted on the forward end of a boom 12 by a pin 13. The dipper stick is thus adapted for to and fro movements in a first plane by means of a hydraulic cylinder partially illustrated at 14 and having its rod pivotally connected to the dipper stick by a pin 15. As will be hereinafter more fully described, the work tool, such as a bucket 16, is universally mounted on a lower end of a dipper stick to condition the bucket for movement in the above-mentioned first plane and/or for sideway movements in a second plane perpendicular to said first plane.

Figure 2:
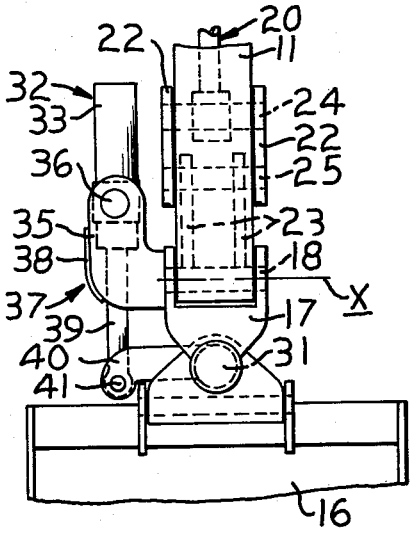
FIG. 2 is an elevational view of a portion of such arrangement, taken in the direction of arrows 11—11 in FIG. 1.
Figure 3:
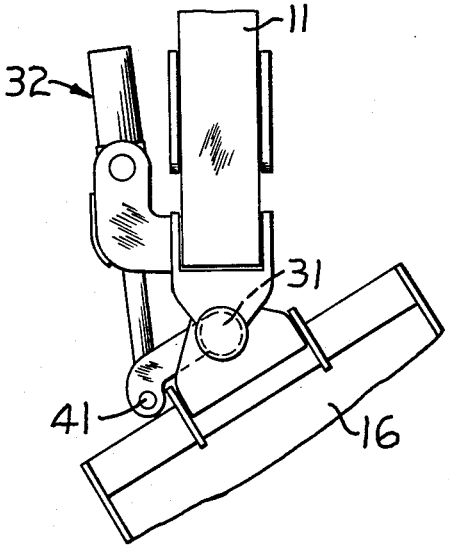
FIG. 3 is a view similar to FIG. 2, but illustrating the bucket in a pivoted condition of operation.

Arrangement 10 further comprises a support bracket 17 pivotally mounted on a lower end of the dipper stick by first pivot means comprising a pin 18. A first actuating means 19 is pivotally interconnected between the dipper stick and the support bracket for selectively moving the support bracket about a pivot axis X of pin 18 (FIG. 2). Such actuating means comprises a double-acting hydraulic cylinder 20 having its upper end pivotally connected to the upper end of the dipper stick by a pin 21 and its lower end pivotally connected to first ends of first and second linkage means 22 and 23, each constituting a pair of links, by a pin 24.

The second end of linkage means 22 is pivotally connected to a lower end of the dipper stick by a pin 25 whereas a second end of second linkage means 23 is pivotally connected to bracket 17 by a pin 26. Bracket 17 has a pair of axially spaced slots 27 and 28 formed thereunder to receive lugs 29 and 30 therein, respectively, formed integrally on the bucket. Second pivot means, comprising a pin 31 mounting lugs 29 and 30 on bracket 27, pivotally mounts the bucket for sideway movements in the above-mentioned second plane about an axis Y.

A second actuating means 32 is pivotally interconnected between support bracket 17 and bucket 16 for selectively moving the bucket in such second plane. The second actuating means preferably comprises a double-acting hydraulic cylinder which is disposed alongside the dipper stick and is generally vertically aligned therewith. A housing 33 of the cylinder is pivotally mounted between a pair of spaced mounting plates 34 and 35 by a pin 36. The mounting plates are formed integrally on a mounting bracket 37 suitably secured to a side of support bracket 17 by welds or the like. A cover plate 38 is secured across outer ends of mounting plates 34 and 35 to cover portions of housing 33 and a rod 39 of cylinder 32 for protective purposes.

The lower end of rod 39 is pivotally connected between a pair of spaced levers 40 by a pivot pin 41. The levers have their inner ends secured to lug 30 for selectively pivoting the bucket about axis Y upon selective extension and retraction of cylinder 32.

In operation, an excavator having dipper stick and bucket arrangement 10 mounted thereon must often times perform side slope digging operations. During such operations, bucket 16 is thus not only adapted to pivot in the first plane about pivot axis X on the dipper stick but is also adapted to be pivoted perpendicular thereto about axis Y and in a second plane perpendicular to the first plane. Such universal bucket movement greatly aids in disposing the bucket in its proper position for such digging operations.

I claim:

1. A dipper stick and bucket arrangement for an excavator comprising, a normally vertically disposed dipper stick a support bracket including spaced parallel upstanding plates having front and rear pin bores provided therein, and a depending portion having transverse pivot means provided therein, and wherein said front pin bores are pivotally connected to the distal end of the stick disposed intermediate said plates, said support bracket also including spaced parallel mounting plates extending from one of said upstanding plates on one side of said support bracket and having pivot bores provided in the distal ends thereof, bucket means including spaced parallel mounting brackets provided on the top thereof each having front and rear pin bores provided therein, bracket means pivotally mounted on said transverse pivot means and on said front and rear bracket pin bores and wherein said bracket means includes spaced parallel levers extending from one side thereof above the bucket intermediate the front and rear portions thereof, and a hydraulic cylinder pivotally connected to said mounting plates and said levers whereby the bucket may be pivoted around said transverse axis upon actuation of said hydraulic cylinder.

2. The invention defined in claim 1 wherein said mounting plates extend from said mounting bracket parallel to and coexistensive with said levers when the bucket is normal to the stick, and then upward from the bucket parallel with the stick, and wherein said arrangement comprises a cover plate extending between the outer upright edges of the mounting plates whereby the hydraulic cylinder means disposed therebetween is enclosed and protected by said cover plate and said mounting plates.

3. The invention defined in claim 2 further comprising, first parallel spaced links pivotally converted to said rear pin bores on said support bracket and extending upwardly therefrom, second parallel spaced links pivotally connected to said first parallel spaced links and to said stick, and a hydraulic cylinder pivotally connected to said first and second parallel links at the juncture thereof and to the stick near the upper end thereof whereby said bucket may be pivoted around the distal end of the stick upon actuation of said hydraulic cylinder.

4. The invention defined in claim 3 wherein the size and relative spacing of the first and second pin bores in the support bracket and on the bucket brackets are similar whereby the bucket may be attached directly to the stick and first links in place of the support bracket.

* * * * *